United States Patent [19]

Tsuyuguchi et al.

[11] 4,318,779

[45] Mar. 9, 1982

[54] METHOD OF MANUFACTURE OF BLAST FURNACE COKES CONTAINING SUBSTANTIAL AMOUNTS OF LOW GRADE COALS

[75] Inventors: Michio Tsuyuguchi; Keiji Kubo; Hiromichi Takahashi, all of Wakayama, Japan

[73] Assignees: Sumikin Coke Company Ltd., Wakayama; Sumitomo Metal Industries Limited, Osaka, both of Japan

[21] Appl. No.: 148,943

[22] Filed: May 12, 1980

[30] Foreign Application Priority Data

May 14, 1979 [JP] Japan ..... 54-59258
Mar. 19, 1980 [JP] Japan ..... 55-35479

[51] Int. Cl.[3] ..... C10B 53/00; C10B 53/08; C10B 55/02; C10B 57/04

[52] U.S. Cl. ..... 201/6; 201/8; 201/21; 201/23; 201/24

[58] Field of Search ..... 201/6, 8, 23, 24, 21, 201/40

[56] References Cited

U.S. PATENT DOCUMENTS

| | | | |
|---|---|---|---|
| 2,782,147 | 2/1957 | Burstlein | 201/8 |
| 3,883,399 | 5/1975 | Nire | 201/6 |
| 4,100,031 | 7/1978 | Kiritani et al. | 201/24 X |

FOREIGN PATENT DOCUMENTS

| | | | |
|---|---|---|---|
| 2643635 | 1/1978 | Fed. Rep. of Germany | 201/6 |
| 2752479 | 5/1979 | Fed. Rep. of Germany | 201/24 |
| 46/7375 | 2/1971 | Japan . | |
| 50/10301 | 2/1975 | Japan | 201/6 |
| 680451 | 11/1949 | United Kingdom | 201/8 |

*Primary Examiner*—Bradley Garris
*Attorney, Agent, or Firm*—Watson, Cole, Grindle & Watson

[57] ABSTRACT

Blast furnace coke containing low grade coal in a high blending ratio is manufactured by a method which comprises blending not less than 60% of a blended coal having an adjusted total moisture content of not more than 4% with not more than 40% of briquettes and carbonizing the resultant mixture.

The blended coal consists essentially of not less than 80% of coking coal and not more than 20% of low grade coal. When coking coal of a kind which has its coking property segregated according to its grain size distribution is pulverized and classified by sifting and the portion of fine particles is used as mixed with the coking coal, the blending ratio of the low grade coal in the blended coal can be increased to up to 35%. The briquettes consist essentially of not less than 10% of coking coal and not more than 90% of low grade coal.

8 Claims, 2 Drawing Figures

METHOD OF MANUFACTURE OF BLAST FURNACE COKES CONTAINING SUBSTANTIAL AMOUNTS OF LOW GRADE COALS

BACKGROUND OF THE INVENTION

1. Field of the Invention:

The present invention is directed to a method of manufacturing an effective blast furnace coke, and more particularly to a method of manufacturing an effective blast furnace coke which contains a substantial amount of low grade coal.

2. Description of the Prior Art:

It is well known that blast furnaces, and especially large sized blast furnaces, require high quality cokes to sustain their operation. At the same time, however, due to the current global shortage of good quality coals, the price of effective blast furnace cokes has gone up. In order to compensate, the coke industry has developed a number of manufacturing processes for the production of blast furnace cokes which can utilize low grade coals, e.g., non-coking coals or poorly coking coals (these being the coals which account for most of the available coals and are the cheapest in cost, but which heretofore have not been considered suitable for use as raw material coals for the manufacture of blast furnace cokes). However, none of these processes have been found to be totally acceptable.

For example, the following manufacturing processes have been developed which make use of low grade coals: a preheated coal charging process (coaltek system or precarbon system) wherein some or all of either a coking coal or a blended coal, which consists of a coking coal and a low grade coal, is preheated at temperatures of from 200° C. to 350° C. and then charged into the coke oven (see Japanese Patent Publication No. 23495/46, published on July 5, 1971); a partial briquette charging process wherein briquettes containing low grade coal are added to a blended coal to be charged into the coke oven (see Japanese Patent Publication No. 7375/46, published on Feb. 24, 1971); a caking substance adding process wherein a charging coal is prepared by adding artifical coking coal or a caking substance to blended coal (see JA-OS 85803/53, laid open for public inspection on July 28, 1978); and a selective pulverization process wherein a coking coal of a kind which has its coking property segregated according to its grain size distribution is pulverized by use of a sieve (see Japanese Patent Publication No. 45763/49, published on Dec. 6, 1974 and Japanese Patent Publication No. 19321/53, published on June 20, 1978).

The above noted preheated coal charging process is believed to provide enhanced strength to the produced coke because the bulk density of the coal charged into the coke oven is increased and the spaces between adjacent coal particles are decreased, and also because the 100° C. zone is totally absent or short during the vaporization of the moisture, the heating rate in the plastic zone is lowered, the thickness of the plastic layer is expanded, and the possibility of adjacent coal particles coalescing is enhanced. Although the blending ratio of the low grade coal is variable with the particular kind of coal being used, it is thought to have a limit of 20% by weight (hereinafter indicated simply in %).

In the case of the above-noted partial briquette charging process, various views have been advanced as to the mechanism which leads to the manifestation of its effect. A typical theory is that expansion of the briquettes in the coking process causes compaction of the coal surrounding the briquettes, which results in an improvement in the coking property. When the blending ratio of briquettes is 60%, incidentally, the bulk density of the coal charged in the coke oven reaches its peak and the stength of the produced coke is improved to the greatest extent. In the operation of this system on a commercial scale, however, the segregation which occurs in the briquettes in the coke oven results in difficulties in discharging the produced coke from the coke oven. Thus, the blending ratio of briquettes is said to be generally limited to about 30%. The proportion of low grade coal which can be blended in total amount of the charging coal is about 20%, though it is variable with the type of low grade coal which is used.

The above-noted caking substance adding process aims to overcome the fluidity problems and improve the quality of the produced coke by the addition of a caking substance. The quality of the caking substance, therefore, is important. Since the caking substance is generally higher in cost than the coal, the proportion of the caking substance economically desirable for addition to the charging coal is generally limited to about 10%. For this reason, the blending ratio of low grade coal is said to be about 20%.

The above-noted selective pulverization process aims to improve the coking property of the charging coal by pulverizing coking coal of a kind which has its coking property segregated according to its grain size distribution, screening the pulverized particles through a sieve 3 to 6 mm in mesh size and pulverizing again the course particles retained on the sieve, whereby the inert particles which reduce the coking property and are concentrically present in the coarse-particle zone will be uniformly distributed throughout the charging coal.

With any of the processes described above, however, the highest possible blending ratio for the low grade coal in the charging coal is about 20%. Thus, the need of developing a method capable of producing a blast furnace coke containing low grade coal in an increased blending ratio has become pressing. Research and developments, thereto, are being promoted on this subject from various angles.

It is, therefore, an object of this invention to provide a method for the manufacture of blast furnace coke by blending low grade coal with coking coal in a high blending ratio.

Another object of the present invention is to provide a method for the manufacture of blast furnace coke by the operation of the partial briquette charging system without necessitating any special means for the prevention of segregation.

SUMMARY OF THE INVENTION

According to the present invention, which combines the partial briquette charging system with the requirement that the total moisture content of the blended coal be lowered to at or below 4%, as the segregation of briquettes in the coke oven is decreased, the blending ratio of briquettes can be increased to 40% in an actual commercial operation without necessitating any special means for preventing the segregation. In addition, the effect of the addition of the caking substance in the briquettes can be promoted and the blending ratio of low grade coal can be notably increased, i.e., by keeping the total moisture content in the briquettes at 4% or below.

Further, this invention allows the blending ratio of the low grade coal to be increased to a still higher level by a procedure which comprises pulverizing coking coal of a kind which has its coking property segregated according to its grain size distribution (such as Australia and Canada origin), mixing the fine particles which have passed the sieve with the other coking coal, blending not less than 65% of the resultant mixture with not more than 35% of low grade coal to produce a blended coal, treating the blended coal so as to keep the total moisture content thereof at or below 4%, separately preparing briquettes comprising not less than 10% of coking coal, not more than 90% of low grade coal and a binder and/or caking substance, blending not less than 60% of the aforementioned blended coal with not more than 40% of the briquettes and thereafter carbonizing the resultant blend. The effect of this invention is additionally improved when the briquettes have their total moisture content adjusted to a level of not more than 4% and when the coarse particles retained on the sieve after pulverizing of coking coal of a kind which has its coking property segregated according to its grain size distribution are again pulverized and used as a substitute for the coking coal in the blended coal or the coking coal in the briquettes.

Other objects, characteristics and advantages of this invention will become apparent from the further disclosure of invention found herein below and considered in conjunction with the accompanying drawing.

DETAILED DESCRIPTION OF THE INVENTIVE EMBODIMENTS

Figure 1:
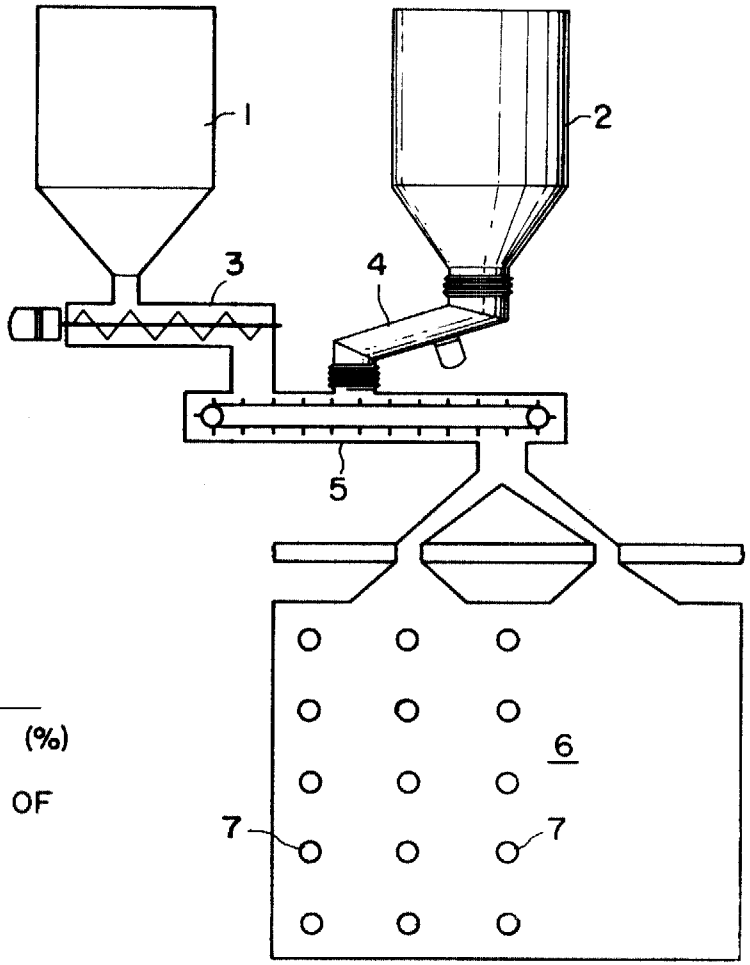
FIG. 1 is a schematic diagram of the test apparatus used in Example 2 of the specification and FIG. 2 is a graph showing the relationship between the total moisture content of the briquettes and the coke strength as discussed in Example 3.

In the following description of this invention, the terms indicated below will be used as defined correspondingly.

By "coking coal" is meant strongly coking coal to weakly coking coal.

By "low grade coal" is meant non-coking coal or poorly coking coal which has the properties of CSN (FSI) 0–2, flowability index 0–10 D.D.P.M., and total dilation index (Audibert Arnu dilatometer) of 0, and which has heretofore been refused acceptance, i.e., has been considered unsuitable, for use in the manufacture of blast furnace coke.

By "blending coal" is meant a coal which includes coking coals or a mixture consisting of desired proportions of coking coal and low grade coal and has been adjusted to have a CSN in the range of 3 to 9 and volatile matter in the range of 25 to 33%.

By "charging coal" is meant a coal which has been prepared by solely using blended coal or by mixing blended coal with briquettes or a caking substance and is ready to be charged into a coke oven.

By "briquette" is meant a product obtained by blending coking coal and low grade coal in a desired blending ratio, adding a caking substance and/or binder to the resultant blend, kneading the mixture and molding it in a unform shape under a roll press.

By "caking substance" is meant an aromatic bituminous substance. For example, coal pitch, asphalt pitch and those pitches which are obtained by heat-treatment or solvent-extraction of coal tar, asphalt, bottom oil remaining after removal of the 230° C. fraction from coal tar (hereinafter referred to as "road tar"), coal pitch, petroleum heavy oil, etc., can be utilized as the caking substance. They may be used in conjunction with solvents such as coal tar, road tar, propane-deasphalting asphalt (PDA), etc. They are invariably capable of improving the coking property and are generally added in a blending ratio of 1 to 30%.

The binder is used for the purpose of enabling the briquettes to retain their original shape. Coal pitch, asphalt, road tar, coal tar, etc., can be used as binders and are generally added in a blending ratio of 5 to 15%.

The first embodiment of this invention comprises causing a blended coal, prepared by mixing not less than 80% of coking coal with not more than 20% of low grade coal, to be preheated or dried to adjust the total moisture content thereof to at or below 4%, separately preparing briquettes by combining not less than 10% of coking coal, not more than 90% of low grade coal and a binder and/or caking substance, then mixing not more than 40% of the briquettes with not less than 60% of the blended coal having an adjusted total moisture content of not more than 4%, and thereafter carbonizing the resultant blend.

In the first embodiment of this invention, the segregation of briquettes occurs less than in the ordinary blended coal (having a total moisture content of 8%), the blending ratio of briquettes can be increased to up to 40%, even when the manufacture is practiced on a commercial scale, and the blending ratio of low grade coal can be substantially increased because the blended coal is adjusted such that its total moisture content is lowered to 4% or below. When the total moisture content of the briquettes is additionally lowered to at or below 4%, the thickness of the plastic layer in the plastic zone is increased similarly to the charging coal involved in the preheated coal charging process, the effect of the addition of caking substance is promoted and the blending ratio of the low grade coal can be increased. Consequently, nearly one half the entire amount of the charging coal can comprise low grade coal.

The upper limit to the blending ratio of low grade coal in the blended coal destined to have its total moisture content lowered to or below 4% is fixed at 20%. The reason for this upper limit of 20% is that the coke strength of the blended coal becomes insufficient (note: under special conditions the blending ratio of low grade coal can exceed 20%).

The upper limit to the blending ratio of low grade coal in the coal material of the briquettes is fixed at 90%. The reason for this limit is that the coke strength becomes insufficient when the blending ratio of low grade coal exceeds 90%.

The upper limit to the total moisture content of the blended coal is fixed at 4%. The reason for this limit is that the coke strength of the blended coal becomes insufficient, the segregation of the briquettes increases, and the blending ratio of briquettes is consequently lowered when the moisture content exceeds 4%.

The blending ratio of briquettes can be increased by adjusting the total moisture content of the blended coal as described above. As already described, the blending ratio of low grade coal is further increased when the total moisture content of the briquettes is additionally lowered to at or below 4%.

The preparation of briquettes having a total moisture content of not more than 4% may be practiced by first kneading the coal material having its total moisture content suitably adjusted in advance and then forming the coal material into briquettes under a roll press, or by first forming the coal material into briquettes under a roll press and then treating the briquettes to have their total moisture content adjusted. The effect of the adjustment of total moisture content is the same regardless of which of the two methods described above is used.

The second embodiment of this invention comprises pulverizing coking coal of a kind which has its coking property segregated according to its grain size distribution, screening the pulverized coal through a sieve, pulverizing further the coarse particles retained on the sieve, then mixing the fine particles collected under the sieve, another coking coal and low grade coal to produce a blended coal and thereafter adjusting the total moisture content of the resultant blend. It may alternatively comprise pulverizing coking coal of a kind which has its coking property segregated according to its grain size distribution, screening the pulverized coal through a sieve, further pulverizing the coarse particles retained on the sieve and using the pulverized particles as a substitute for the coking coal in the briquettes.

Specifically, according to the second embodiment of this invention, in the manufacture of blast furnace coke by the carbonization of the charging coal prepared by blending the blended coal with the briquettes, the coking coal of a kind which has its coking property segregated according to its grain size distribution is first pulverized and the pulverized coal is screened through a sieve, the fine particles collected under the sieve are mixed with another coking coal, not less than 65% of the resultant mixture and not more than 35% of low grade coal are combined to form a blended coal, and the blended coal is treated to have its total moisture content lowered to at or below 4%. Separately, briquettes are prepared with not less than 10% of coking coal, not more than 90% of low grade coal and a binder and/or a caking substance. Thereafter, not less than 60% of the aforementioned blended coal and not more than 40% of the briquettes are blended and subjected to carbonization.

The preheated coal charging process has the effect of increasing the bulk density of the charging coal in the coke oven, promoting the compaction of the coal particles, and assisting in the action of mutual fusion between the low molecular weight portion and the higher molecular weight portion in the plastic zone. When this process is used in combination with the aforementioned selective pulverization system, a synergistic effect is achieved in that the dispersion of the low molecular weight portion is promoted in the course of preheating because the inert particles which are inhibitory of the coking property and concentrically present in the course particles portion are allowed to be uniformly distributed throughout the blended coal. As a result, the blending ratio of low grade coal can be notably increased. Moreover, since the total moisture content of the blended coal is adjusted to, similarly to that in the first embodiment, at or below 4%, preparatorily to the mixing of the blended coal with the briquettes, the segregation of briquettes in the coke oven is decreased, the blending ratio of the briquettes during the commercial operation of the invention can be increased up to 40% without necessitating any special means for precluding the segregation, and the blending ratio of low grade coal can be increased.

Also in the second embodiment, when the total moisture content of the briquettes is additonally adjusted to at or below 4%, the addition which is made as one of the effects of the preheating to the thickness of the plastic layer in the plastic zone furthers the possibility of adjacent coal particles being united and permits the blending ratio of the low grade coal in the briquettes to be proportionately increased. The effect just described when additionally adding the caking substance during the preparation of briquettes is advanced and the blending ratio of low grade coal in the briquettes is further increased. When the coarse particles retained on the sieve are pulverized again and are added into the briquettes, the amount of the fine particles collecting under the sieve is changed and the blending ratio of low grade coal in the blended coal is increased.

For the reasons described in detail above, the present invention, which uses a specific combination of steps, permits manufacture of blast furnace coke from a charging coal containing up to 50% of low grade coals.

In the second embodiment, the upper limit to the blending ratio of low grade coal in the blended coal is fixed at 35%. The reason for this upper limit is that the coke strength becomes insufficient when the blending ratio of low grade coal exceeds 35%.

The reasons for and the effects of fixing the upper limit to the blending ratio of low grade coal in the briquettes at 90%, adjusting the total moisture content of the blended coal at or below 4% and fixing the upper limit to the total moisture content of the briquettes at 4% are the same as those of the first embodiment.

Working examples of the present invention will now be given to illustrate the effects of the invention.

EXAMPLE 1

A blended coal, A, formed solely of coking coal and a low grade coal, B, indicated in Table 1 were blended in varying ratios indicated in Table 2, treated with a fluidized bed 300 mm in diameter to acquire respectively prescribed tool moisture contents, placed in 18-liter tin cans, charged an electric furnace at 800° C. and left to stand therein for four hours, then heated up to 1000° C. at a heating rate of 3.3° C./min., kept at this temperature for three hours, then discharged from the electric furnace, quenched with sprayed water and tested for coke strength in accordance with JIS K-2151-6. (This standard will be invariably used in the tests to be indicated herein below). The results are shown in Table 2.

TABLE 1

| | Proximate analysis (%) | | | | | | Particle size (Below 3 mm) (%) |
|---|---|---|---|---|---|---|---|
| | Moisture | Ash | Volatile matter | Fixed carbon | CSN | F.I. (Log DDPM) | |
| Blended coal, A | 1.6 | 8.7 | 26.3 | 63.4 | 4½ | 2.10 | 85 |
| Low grade coal, B | 2.7 | 8.8 | 34.1 | 54.4 | ½ | No. rotation | 85 |

(Note)
Proximate analysis was made in accordance with JIS M-8812, CSN in accordance with JIS M-8801-5 and FI in accordance with JIS M-8801-7 respectively. (These standards will be invariably used in the tests to be indicated herein below.)

TABLE 2

| Run No. | Blending ratio | Total moisture (%) | Bulk density in tin can (kg/m³) | Coke strength $DI_{15}^{30}$ (%) | Coke strength $DI_{15}^{150}$ (%) |
|---|---|---|---|---|---|
| 1 | Blended coal A 100% | 8.0 | 750 | 93.8 | 83.0 |
| 2 | " | 6.0 | 800 | 94.1 | 83.9 |
| 3 | " | 4.0 | 850 | 94.6 | 86.1 |
| 4 | " | 2.0 | 870 | 94.8 | 86.5 |
| 5 | " | 0 | 870 | 94.8 | 86.6 |
| 6 | Blended coal A 90% + low grade coal B 10% | 8.0 | 750 | 89.2 | 75.7 |
| 7 | Blended coal A 90% + low grade coal B 10% | 5.0 | 810 | 90.8 | 76.8 |
| 8 | Blended coal A 90% + low grade coal B 10% | 3.0 | 860 | 94.9 | 86.3 |
| 9 | Blended coal A 90% + low grade coal B 10% | 0 | 870 | 95.4 | 86.4 |
| 10 | Blended coal A 80% + low grade coal B 20% | 8.0 | 750 | 85.2 | 68.7 |
| 11 | Blended coal A 80% + low grade coal B 20% | 5.0 | 810 | 87.8 | 74.9 |
| 12 | Blended coal A 80% + low grade coal B 20% | 3.0 | 860 | 93.3 | 82.5 |
| 13 | Blended coal A 80% + low grade coal B 20% | 0 | 870 | 93.8 | 82.9 |
| 14 | Blended coal A 70% + low grade coal B 30% | 0 | 870 | 91.4 | 78.2 |

(Note)
Total moisture content was determined in accordance with the method for simplified measurement of total moisture content defined by JIS M-8811-6; (This method will be invariably used in the tests to be indicated herein below.)
Bulk density in the tin can was determined by placing a 10-kg sample in an iron box 235 mm in width × 235 mm in length × 355 mm in height, dropping the box from a height of 11 cm onto an iron plate three times and finding the height of the sample held in the box. (This method will be invariably used in the tests to be indicated hereinbelow.)

It is seen from Table 2 that the effect of the preheating of the blended coal A was particularly conspicuous in the test runs involving total moisture contents of not more than 4% and the blendability of the blended coal A for blending the low grade coal B is limited to about 20%.

EXAMPLE 2

A blended coal, A, indicated in Table 1 above, was treated with the aforementioned fluidized bed to acquire a varying prescribed total moisture content ranging from 8% to 2%, and fed into the hopper 1 of a test apparatus illustrated in FIG. 1. Separately, masec type briquettes (with a total moisture content fixed at 8% and 2%) having a composition shown in Table 3 and measuring 35 mm×35 mm×25 mm were fed into the briquette hopper 2. By the operation of the screw feeder 3 and the vibration feeder 4, the blended coal, A and the briquettes, were drawn out of the hopper 1 and the briquette hopper 2 respectively at a prescribed proportion, transferred through the medium of the scraper type conveyor 5 into the full-scale model coke oven of steel plates improvised by halving only lengthwise the carbonization chamber of a large coke oven measuring 7.1 m in height, 16.5 m in length and 0.46 m in width, and discharged through the sample outlet 7. The samples thus obtained were tested for segregation of briquettes.

The results are shown in Table 4. The value given in the Table 4 represent averages of the five samples in heightwise of the full-scale model coke oven.

TABLE 3

| | Blending ratio (%) |
|---|---|
| Blended coal, A | 40 |
| Low grade coal, B | 60 |
| Road tar (Additional) | 7 |

TABLE 4

| | Blending ratio of briquettes (%) | Percentage of briquettes contained at varying position (%): Oven door side | Underside of charging hole | Midway between charging holes | Percentage of contained briquettes (R) (max. − Min.) | Max. variation coefficient of briquettes |
|---|---|---|---|---|---|---|
| Total moisture 8% | 20 | 29.3 | 11.7 | 30.7 | 19.0 | 1.54 |
| Blended coal, A | 30 | 34.6 | 14.1 | 43.4 | 29.3 | 1.46 |
| Total moisture, 8% | 40 | 42.8 | 17.5 | 55.9 | 38.4 | 1.40 |
| Briquettes | 50 | 50.0 | 30.9 | 76.9 | 46.0 | 1.54 |
| Total moisture 6% | 20 | 30.1 | 11.9 | 30.2 | 18.3 | 1.51 |
| Blended coal, A | 30 | 35.3 | 13.0 | 42.0 | 29.0 | 1.40 |
| Total moisture, 8% | 40 | 43.1 | 19.8 | 58.0 | 38.2 | 1.45 |
| Briquettes | 50 | 51.1 | 28.5 | 74.0 | 45.5 | 1.48 |
| Total moisture 4% | 20 | 14.1 | 23.6 | 20.4 | 9.5 | 1.18 |
| Blended coal, A | 30 | 21.8 | 32.1 | 27.3 | 10.3 | 1.07 |
| Total moisture, 8% | 40 | 49.2 | 38.0 | 39.6 | 11.2 | 1.23 |
| Briquettes | 50 | 69.5 | 42.8 | 44.7 | 26.7 | 1.39 |
| Total moisture 2% | 20 | 14.2 | 22.2 | 20.8 | 8.0 | 1.11 |
| Blended coal, A | 30 | 27.4 | 31.2 | 29.8 | 3.8 | 1.04 |
| Total moisture, 8% | 40 | 46.9 | 36.8 | 37.5 | 10.1 | 1.17 |
| Briquettes | 50 | 65.9 | 41.9 | 45.6 | 24.0 | 1.32 |
| Total moisture 2% | 20 | 14.5 | 22.9 | 21.0 | 8.4 | 1.14 |
| Blended coal, A | 30 | 28.0 | 31.0 | 28.5 | 3.0 | 1.03 |
| Total moisture, 2% | 40 | 47.5 | 37.3 | 38.1 | 10.2 | 1.19 |
| Briquettes | 50 | 66.6 | 42.3 | 45.0 | 24.3 | 1.33 |
| Total moisture 8% | 20 | 31.2 | 10.3 | 32.0 | 21.7 | 1.60 |
| Blended coal, A | 30 | 35.0 | 13.9 | 44.5 | 30.6 | 1.48 |
| Total moisture, 2% | 40 | 41.6 | 18.2 | 59.3 | 41.1 | 1.48 |
| Briquettes | 50 | 48.7 | 29.7 | 78.1 | 48.4 | 1.56 |

(Note)
Max. variation coefficient of briquettes = Max. percentage of contained briquettes/blending ratio.

It is seen from Table 4 that in the samples involving addition of briquettes to the blended coal, A, having a total moisture content of 8%, the percentages of contained briquettes were decreased to the order of about 50% of the blending ratio of briquettes without reference to the total moisture content of the briquettes and that in the samples blending briquettes in the blending ratio of 40%, portions having the maximum percentage of briquettes in the neighborhood of 60% occurred locally within the coke oven, suggesting the possibility of pushing troubles and other difficulties in discharging from the coke oven.

In the case of the samples involving addition of briquettes to the blended coals, A, having total moisture contents of 4% and 2%, the variations in the percentages of contained briquettes are fairly low in the range of 10 to 20% without reference to the total moisture content of briquettes where the blending ratio of briquettes are up to 40%, suggesting that even in the commercial operation, the blending ratio of briquettes can be increased up to 40%.

The data indicate that the segregation caused in the coke oven by the addition of briquettes depends more on the total moisture content of the blended coal than on that of the briquettes. The total moisture content of the briquettes was determined by the method for determination of total moisture content (toluene process) specified by JIS K-2425-9. (This method will be invariably used in the tests to be indicated herein below.)

EXAMPLE 3

Figure 2:
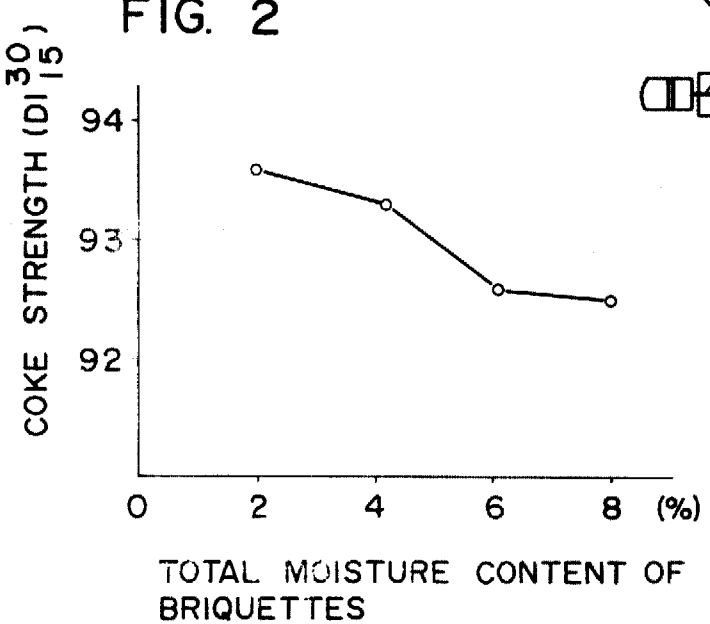

A blended coal, C, indicated in Table 5 and formed solely of coking coal was treated with the same fluidized bed as used in Example 1 to acquire a total moisture content of 2%. The coal material for briquetting, having the same composition as shown in Table 3, was treated with a drier to acquire a stated total moisture content, kneaded with 7% of added road tar at 50° to 60° C. for 10 minutes and formed into masec type briquettes 35 mm×35 mm×25 mm with a roll press. The briquettes were mixed in a blending ratio of 30% with the aforementioned blended coal, C. The resultant blend was carbonized by the procedure of Example 1 and the produced coke was tested for coke strength. The relation between the total moisture content of the briquettes and the coke strength is shown in FIG. 2.

TABLE 5

| | Proximate analysis (%) | | | | | | |
|---|---|---|---|---|---|---|---|
| | Moisture | Ash | Volatile matter | Fixed carbon | CSN | F.I. (Log DDPM) | Particle size (Below 3 mm) (%) |
| Blended coal, C | 1.7 | 8.7 | 27.2 | 62.4 | 5½ | 1.36 | 85% |

Separately, the aforementioned material coal for briquetting in a state retaining intact its total moisture content was kneaded with 7% of road tar added thereto at 50° to 60° C. for 10 minutes. The mixture was formed into masec type briquettes 35 mm×35 mm×25 mm with a roll press. The briquettes were treated with a drier to acquire a total moisture content of 2% and mixed in a blending ratio of 30% with the blended coal, C, having an adjusted total moisture content of 2%. The resultant mixture was carbonized under the same conditions as those of Example 1 and then tested for coke strength, $DI_{15}^{30}$, which was found to be 93.5. This value is practically identical with the value 93.6 of the coke strength, $DI_{15}^{30}$, found for the coke which is produced by blending the briquettes of the type (having a total moisture content of 2%) formed by first treating the material coal for total moisture content adjustment and thereafter molding the material coal with a roll press.

This fact shows that the effect of the blend of briquettes is the same, no matter whether the briquettes are obtained by first treating the coal material for to adjust its total moisture content and thereafter molding the material coal with a roll press or are obtained by first molding the material coal with a roll press and thereafter treating the shaped blocks of coal material to adjust their total moisture content. This means that the effect has absolutely nothing to do with the procedure to be followed in the preparation of the briquettes.

EXAMPLE 4

By following the procedure of Example 1, a blended coal, D, formed solely of coking coal and a low grade coal, E, indicated in Table 6 were treated to have their total moisture contents adjusted to 8% in some test runs and 2% in others and were mixed with each other at varying ratios indicated in Table 7. The resultant blends were mixed with the blended coal, D, low grade coal, E, and road tar at the varying blended ratios also indicated in Table 7, kneaded at 50° to 60° for 10 minutes and thereafter mixed with 40% of masec type briquettes 35 mm×35 mm×25 mm formed in advance with a roll press. The resultant mixtures were carbonized by the procedure of Example 1 and tested for coke strength.

The results are shown in Table 7.

TABLE 6

| | Proximate analysis (%) | | | | | | |
|---|---|---|---|---|---|---|---|
| | Moisture | Ash | Volatile matter | Fixed carbon | CSN | F.I. (Log DDPM) | Particle size (Below 3 mm) (%) |
| Blended coal, D | 1.3 | 8.9 | 26.4 | 63.4 | 5½ | 1.92 | 85 |
| Low grade coal, E | 2.6 | 10.0 | 32.9 | 54.5 | 1 | 1.0 | 85 |

TABLE 7

| | Blended coal | | | Briquettes | | | | | |
|---|---|---|---|---|---|---|---|---|---|
| | | Blending ratio | | | Blending ratio | | | | |
| Run No. | Total moisture (%) | Blended coal, D (%) | Low grade coal, E (%) | Total moisture (%) | Blended coal, D (%) | Low grade coal, E (%) | Binder Road tar (%) | Total low grade coal content (%) | Coke strength $DI_{15}^{150}$ (%) |
| 15 | 8.0 | 100 | 0 | — | — | — | — | — | 83.4 |
| 16 | 8.0 | 100 | 0 | 8.0 | 60 | 40 | 7 | 16 | 84.1 |
| 17 | 8.0 | 100 | 0 | 8.0 | 40 | 60 | 7 | 24 | 83.4 |
| 18 | 8.0 | 100 | 0 | 8.0 | 20 | 80 | 7 | 32 | 82.6 |
| 19 | 2.0 | 100 | 0 | — | — | — | — | 0 | 85.1 |
| 20 | 2.0 | 80 | 20 | — | — | — | — | 20 | 83.4 |
| 21 | 2.0 | 60 | 40 | — | — | — | — | 40 | 82.6 |

TABLE 7-continued

| Run No. | Blended coal: Total moisture (%) | Blended coal: Blending ratio: Blended coal, D (%) | Blended coal: Blending ratio: Low grade coal, E (%) | Briquettes: Total moisture (%) | Briquettes: Blending ratio: Blended coal, D (%) | Briquettes: Blending ratio: Low grade coal, E (%) | Binder Road tar (%) | Total low grade coal content (%) | Coke strength $DI_{15}^{150}$ (%) |
|---|---|---|---|---|---|---|---|---|---|
| 22 | 2.0 | 80 | 20 | 8.0 | 60 | 40 | 7 | 28 | 84.2 |
| 23 | 2.0 | 80 | 20 | 8.0 | 40 | 60 | 7 | 36 | 83.5 |
| 24 | 2.0 | 80 | 20 | 8.0 | 20 | 80 | 7 | 44 | 82.7 |
| 25 | 2.0 | 80 | 20 | 2.0 | 60 | 40 | 7 | 28 | 84.5 |
| 26 | 2.0 | 80 | 20 | 2.0 | 40 | 60 | 7 | 36 | 84.1 |
| 27 | 2.0 | 80 | 20 | 2.0 | 25 | 75 | 7 | 42 | 83.5 |
| 28 | 2.0 | 80 | 20 | 2.0 | 20 | 80 | 7 | 44 | 83.0 |

It is seen from Table 7 that in Run No. 23, which involved combined use of the preheated coal (blended coal, D) charging process and the partial briquette charging process, the total low grade coal content was 36%, a value about 12% more than the value 24% obtained in Run No. 17, which represented sole application of the partial briquette charging system. It is further seen that in Run No. 27, which involved additional use of briquettes having an adjusted total moisture content of 2%, the low grade coal could be blended in a ratio of 42%.

These high low grade coal contents were ascribable respectively to the synergistic effect of the combined use of the preheated coal charging process and the partial briquette charging process and to the synergistic effect of the additional use of dried briquettes.

EXAMPLE 5

The same blended coal as used in Run No. 20 of Example 4 was mixed with 40% of briquettes indicated in Table 9 and produced by the procedure of Example 4. The resultant mixture was carbonized by the procedure of Example 1 and the coke thus obtained was tested for coke strength. The results are shown in Table 9.

The properties of the caking substance added in the briquettes are shown in Table 8.

TABLE 8

| | Softening point (°C.) | Fixed carbon (%) | Insolubles in solvent extraction (%): n-hexane | Benzene | Carbon disulfide | Quinoline | Ultimate analysis (%): C | H | N | S |
|---|---|---|---|---|---|---|---|---|---|---|
| Caking substance | 187 | 57.9 | 79.2 | 48.3 | 34.1 | 14.7 | 85.7 | 5.9 | 1.9 | 7.0 |

TABLE 9

| Run No. | Blended coal: Total moisture (%) | Blended coal: Blending ratio: Blended coal, D (%) | Blended coal: Blending ratio: Low grade coal, E (%) | Briquettes: Total moisture (%) | Briquettes: Blending ratio: Blended coal, D (%) | Briquettes: Blending ratio: Low grade coal, E (%) | Caking substance (%) | Road tar (additional) (%) | Coal tar (additional) (%) | Total low grade coal content (%) | Coke strength, $D_{15}^{150}$ (%) |
|---|---|---|---|---|---|---|---|---|---|---|---|
| 29 | 2.0 | 80 | 20 | 8.0 | 25 | 75 | — | 7 | — | 42 | 83.0 |
| 30 | 2.0 | 80 | 20 | 6.0 | 25 | 75 | — | 7 | — | 42 | 83.0 |
| 31 | 2.0 | 80 | 20 | 4.0 | 25 | 75 | — | 7 | — | 42 | 83.4 |
| 32 | 2.0 | 80 | 20 | 2.0 | 25 | 75 | — | 7 | — | 42 | 83.4 |
| 33 | 2.0 | 80 | 20 | 8.0 | 13.5 | 81 | 5.5 | 7 | — | 44.4 | 83.0 |
| 34 | 2.0 | 80 | 20 | 6.0 | 13.5 | 81 | 5.5 | 7 | — | 44.4 | 83.2 |
| 35 | 2.0 | 80 | 20 | 4.0 | 13.5 | 81 | 5.5 | 7 | — | 44.4 | 83.9 |
| 36 | 2.0 | 80 | 20 | 2.0 | 13.5 | 81 | 5.5 | 7 | — | 44.4 | 84.0 |
| 37 | 2.0 | 80 | 20 | 2.0 | 9.5 | 85 | 5.5 | 7 | — | 46 | 83.4 |
| 38 | 2.0 | 80 | 20 | 2.0 | 4.5 | 90 | 5.5 | 7 | — | 48 | 82.8 |
| 39 | 2.0 | 80 | 20 | 2.0 | 9.5 | 85 | 5.5 | — | 7 | 46 | 83.4 |
| 40 | 2.0 | 80 | 20 | 2.0 | 4.5 | 90 | 5.5 | — | 7 | 48 | 82.7 |

It is seen from Table 9 that addition of the caking substance by a blending ratio of 5.5% to briquettes permitted the blending ratio of the low grade coal, E, into the briquettes to be increased by 6% in the case of briquettes having a total moisture content of 8%, and that the increase in the blending ratio was raised to 10% when the total moisture content of briquettes was lowered to 2%.

This fact shows that the effect of the addition of the caking substance into the briquettes is manifested more conspicuously when the total moisture content of briquettes is lowered. Thus, the reduction in the total moisture content brings about what may well be called an unexpected effect.

EXAMPLE 6

Blended coals, F and G, of the respective compositions indicated below were subjected to a varying pretreatment (I through IV) described below, and placed in 18-liter tin cans, then the blended coal was carbonized by the procedure of Example 1, and tested for coke strength. The results of the test are shown in Table 10.

| | |
|---|---|
| Blended coal, F: | |
| Strongly coking coal from U.S.A. | 25% |
| Semi-strongly coking coal from Australia | 55% |
| Domestic weakly coking coal | 20% |
| Blended coal, G: | |
| Strongly coking coal from Australia | 25% |
| Semi-strongly coking coal from U.S.A. | 55% |
| Domestic weakly coking coal | 20% |

Description of pretreatment:

I: The given blended coal was pulverized to an extent enough to produce coal particles containing 80% of particles of sizes not exceeding 3 mm and then was adjusted to acquire a total moisture content of 8%.

II: The blended coal which had undergone Pretreatment I was preheated at 200° C. in a fluidized bed 350 mm in diameter and then left to cool off on an iron plate.

III: Of the component coals making up a given blended coal, the coking coal of Australian origin was pulverized. The resultant particles were screened through a 6-mm sieve, and the coarse particles retained on the sieve were again pulverized, to produce particles containing 80% of particles of sizes not exceeding 3 mm. The remaining two component coking coals were pulverized to produce particles containing 80% of particles of sizes not exceeding 3 mm. Then, these particles (course particles pulverized again and fine particles passed the sieve of Australian origin, the other coking coals) obtained as described above were mixed.

IV: The blended coal which had undergone Pretreatment III was preheated at 200° C. and then left to cool off on an iron plate similarly to Pretreatment II.

TABLE 10

| Run No. | Pre-treat-ment | Total moisture (%) | Bulk density in tin can (kg/m$^3$) | Coke strength $D_{15}^{30}$ (%) Blended coal, F | Blended coal, G |
|---|---|---|---|---|---|
| 41 | I | 8.0 | 750 | 92.1 | 92.2 |
| 42 | II | 0 | 870 | 92.8 | 92.9 |
| 43 | III | 8.0 | 750 | 92.5 | 92.7 |
| 44 | IV | 0 | 870 | 93.6 | 93.5 |

TABLE 11

| Kind of coal | Screening | Mesh size 4 mm Percentage | CSN | Mesh size 6 mm Percentage | CSN |
|---|---|---|---|---|---|
| Strongly coking coal | Retained | 48.6 (%) | 1½ | 40.3 (%) | 1½ |
| | Passed | 51.4 | 6 | 59.3 | 5½ |
| Semi-strongly coking coal | Retained | 49.1 | 1½ | 37.9 | 1½ |
| | Passed | 50.9 | 6 | 62.1 | 5 |

(Note)
Table 11 shows the percentages at which the coal particles resulting from the aforementioned pulverization of the coking coal of Australian origin were partly retained on and partly passed through sieves 4 mm and 6 mm in mesh size when they were screened through the sieves, and the respective CSN values.

EXAMPLE 7

The blended coal, F, of Example 6 was mixed at a varying blending ratio with a low grade coal, H, shown in Table 12. The resultant mixtures were subjected to the pretreatments of Example 6, with and without modifications. Specifically, Pretreatments I and II were performed in their unmodified form. Pretreatment III' comprised pulverizing only the semi-strongly coking coal of Australian origin of a given blended coal, screening the resulting particles through a 6-mm sieve and pulverizing again the coarse particles retained on the sieve to produce particles containing 80% of particles of sizes not exceeding 3 mm, then mixing the pulverized course particles and fine particles which passed the sieve of Australian origin with the remaining coking coals and low grade coal H which had been separately pulverized into particles containing 80% of particles of sizes not exceeding 3 mm. And Pretreatment IV' comprised causing the coal resulting from Pretreatment III' to be preheated at 200° C. and then left to cool off on an iron plate similarly to Pretreatment II. The blended coal obtained by each of the pretreatments was carbonized and then tested for coke strength similarly to Example 6. The results are shown in Table 13.

TABLE 12

| | Proximate analysis (%) Moisture | Ash | Volatile matter | Fixed carbon | CSN | FI (Log DDPM) | Particle size (below 3 mm) |
|---|---|---|---|---|---|---|---|
| Low grade coal H | 2.7 | 8.8 | 34.1 | 54.4 | ½ | No rotation | 80% |

TABLE 13

| Run No. | Pre-treat-ment | Blending ratio (%) Blended coal, F | Low grade coal, H | Total moisture | Bulk density in tin can (kg/m$^3$) | Coke strength $DI_{15}^{30}$ (%) |
|---|---|---|---|---|---|---|
| 45 | I | 95 | 5 | 8.0 | 750 | 91.2 |
| 46 | II | 90 | 10 | 0 | 870 | 92.5 |
| 47 | II | 80 | 20 | 0 | 870 | 92.1 |
| 48 | II | 70 | 30 | 0 | 870 | 91.4 |
| 49 | III' | 95 | 5 | 8.0 | 750 | 92.1 |
| 50 | III' | 90 | 10 | 8.0 | 750 | 91.8 |
| 51 | IV' | 90 | 10 | 0 | 870 | 93.2 |
| 52 | IV' | 80 | 20 | 0 | 870 | 92.8 |
| 53 | IV' | 70 | 30 | 0 | 870 | 92.1 |
| 54 | IV' | 60 | 40 | 0 | 870 | 91.2 |

It is seen from Table 13 that in Run Nos. 51-54 involving Pretreatment IV', namely, the steps of selectively pulverizing the coking coal of Australian origin, mixing the resultant coal particles with the other coking coals to form the blended coal, F, combining the blended coal, F, with the low grade coal, H, and thereafter treating the resultant blend for total moisture content adjustment, blends were produced which each consisted of 70% of the blended coal, F, and 30% of the low grade coal, H.

EXAMPLE 8

The material coal for briquetting prepared by blending the same low grade coal, H, (Table 12) as used in Example 7 in a varying blending ratio with the blended coal, G, of Example 6 and road tar having a softening point of 25° C. and added thereto as a binder were kneaded at 50° to 60° C. for 10 minutes. The resultant mixture was formed into masec type briquettes 35 mm×35 mm×25 mm with a roll press. The adjusted total moisture content of the briquettes was 8% in some test runs and 2% in others.

Then, the blended coal blended of 70% of the blended coal, G, of Example 6 and 30% of the low grade coal, H, of Example 7 was subjected to Pretreatment IV' and mixed with 40% of a varying type of briquettes prepared as described above. The resultant mixture was carbonized by the procedure of Example 6, and the coke was tested for coke strength. The blending ratio of the material coals for briquetting and the results of the test for coke strength are shown in Table 14.

TABLE 14

| Run No. | Blended coal (%) Total moisture | Blending ratio Blended coal, G | Low grade coal, H | Briquettes (%) Total moisture | Blending ratio Blended coal, G | Low grade cla, H | Binder (additional) | Total low grade coal content (%) | Bulk density in tin can (kg/m³) | Coke strength $DI_{15}^{30}$ (%) |
|---|---|---|---|---|---|---|---|---|---|---|
| 55 | 0 | 70 | 30 | 8.0 | 60 | 40 | 7 | 34 | 950 | 92.3 |
| 56 | 0 | 70 | 30 | 8.0 | 50 | 50 | 7 | 38 | 950 | 92.1 |
| 57 | 0 | 70 | 30 | 8.0 | 40 | 60 | 7 | 42 | 950 | 91.1 |
| 58 | 0 | 70 | 30 | 2.0 | 60 | 40 | 7 | 34 | 950 | 93.0 |
| 59 | 0 | 70 | 30 | 2.0 | 50 | 50 | 7 | 38 | 950 | 92.5 |
| 60 | 0 | 70 | 30 | 2.0 | 40 | 60 | 7 | 42 | 950 | 92.1 |
| 61 | 0 | 70 | 30 | 2.0 | 30 | 70 | 7 | 46 | 950 | 91.7 |

It is seen from Table 14 that in the coke of the charging coal consisting of 60% of the blended coal containing 30% of the low grade coal, H, and 40% of the briquettes, the proportion of the low grade coal to the whole amount of the charging coal was 38% when the briquettes had a total moisture content of 8% (Run No. 56), whereas the proportion could be increased to 42% when the briquettes incorporated had a total moisture content of 2% (Run No. 60).

TABLE 15-continued

| | Softening point (°C.) | Fixed carbon (%) | Insolubles in solvent extraction (%) n-Hexane | Benzene | Carbon disulfide | Quinoline |
|---|---|---|---|---|---|---|
| Caking substance | 187 | 57.9 | 79.2 | 48.3 | 34.1 | 14.7 |

| | Ultimate analysis (%) C | H | N | S |
|---|---|---|---|---|
| | 85.7 | 5.9 | 1.2 | 7.0 |

TABLE 16

| Run No. | Blended coal (%) Total moisture | Blending ratio Blended coal, G | Low grade coal, H | Briquettes (%) Total moisture | Blending ratio Blended coal, G | Low grade coal, H | Caking substance | Binder (Additional) | Total low grade coal content (%) | Bulk density in tin can (kg/m³) | Coke strength $DI_{15}^{30}$ (%) |
|---|---|---|---|---|---|---|---|---|---|---|---|
| 62 | 0 | 70 | 30 | 8.0 | 39.5 | 55 | 5.5 | Coal tar 7 | 40 | 950 | 92.2 |
| 63 | 0 | 70 | 30 | 8.0 | 34.5 | 60 | 5.5 | Coal tar 7 | 42 | 950 | 91.4 |
| 64 | 0 | 70 | 30 | 8.0 | 39.5 | 55 | 5.5 | Road tar 7 | 40 | 950 | 92.1 |
| 65 | 0 | 70 | 30 | 2.0 | 29.5 | 65 | 5.5 | Coal tar 7 | 44 | 950 | 92.7 |
| 66 | 0 | 70 | 30 | 2.0 | 19.5 | 75 | 5.5 | Coal tar 7 | 48 | 950 | 92.1 |
| 67 | 0 | 70 | 30 | 2.0 | 9.5 | 85 | 5.5 | Coal tar 7 | 52 | 950 | 91.6 |
| 68 | 0 | 70 | 30 | 2.0 | 19.5 | 75 | 5.5 | Road tar 7 | 48 | 950 | 92.1 |

EXAMPLE 9

By the procedure of Example 8, briquettes were formed of what was obtained by mixing the low grade coal, H, indicated in Table 12 in a varying blending ratio with the blended coal, G, used in Example 6 and adding to the resultant mixture a binder (there was used coal tar or road tar) and a caking substance as shown in Table 15. Then, 60% of the blended coal which was obtained by mixing the blended coal, G, with 30% of the low grade coal, H, and subjecting the resultant mixture to Pretreatment IV' was mixed with 40% of the briquettes obtained as described above. The resultant blend was carbonized by following the procedure of Example 6, and the coke was tested for coke strength.

The composition of the briquettes and the results of the test for coke strength are shown in Table 16.

It is seen from Table 16 that the addition of the caking substance in a blending ratio of 5.5% to the briquettes permitted the total low grade coal content to be increased by 2% in the case of briquettes having a total moisture content of 8% (Run Nos. 56–62) and that the increase in the total low grade coal content rose to 6% in the case of briquettes having a total moisture content of 2% (Run Nos. 60–66). This fact shows that the effect of the addition of the caking substance into the briquettes is conspicuously enhanced by a decrease in the total moisture content of the briquettes.

EXAMPLE 10

Of the blended coal, G, shown in Example 6, the strongly coking coal of Australian origin was pulverized. The resultant particles were screened through a 6-mm sieve. The fine particles collecting under the 6-mm sieve were mixed with the remaining semi-strongly coking coal and weakly coking coal. The resultant mixture was blended in a varying blending ratio with the low grade coal, H, shown in Table 12 of Example 7. The blended coal thus obtained was treated to be given an adjusted total moisture content of 2% and carbonized by following the procedure of Example 6, and the coke was tested for coke strength. The results are shown in Table 17.

TABLE 17

| Run No. | Blending ratio (%) Particles of strongly coking coal of Australian orgin retained on the sieve | Particles of strongly coking coal of Australian orgin passed through the sieve | Semi-strongly coking of coal U.S.A. origin | Weakly coking coal | Low grade coal, H | Bulk Density in tin can (kg/m$^3$) | Coke strength $DI_{15}^{30}$ (%) |
|---|---|---|---|---|---|---|---|
| 69 | 0 | 11.6 | 42.9 | 15.5 | 30 | 870 | 92.5 |
| 70 | 0 | 10.8 | 39.8 | 14.4 | 35 | 870 | 92.1 |
| 71 | 0 | 10.0 | 36.7 | 13.3 | 40 | 870 | 91.5 |

It is seen from Table 17 that the blended coal formed without blending the particles retained on the sieve of the strongly coking coal of Australian origin abounded with inert particles and permitted blending of as much as 35% of the low grade coal when the blended coal was treated to be given an adjusted total moisture content of 2%.

EXAMPLE 11

The particles retained on the sieve of the strongly coking coal of Australian origin which were not blended in the blended coal in Example 10 were further pulverized and used as the coal material for briquetting. By following the procedure of Example 8, briquettes were formed of what was obtained by mixing the additionally pulverized particles with the caking substance indicated in Table 15 and road tar or coal of Run No. 70 of Example 10, 40% of either varying the blending ratio of low grade coal or the varying the total moisture content of the briquettes obtained as described above were mixed. The resultant mixture was carbonized by the procedure of Example 1 and the coke was tested for coke strength. The blending ratios of material coals and the results of the test for coke strength are shown in Table 18.

It is seen that the low grade coal content of the blended coal can be increased to a great extent, as is plain from Example 9, by using as the coal material for briquetting the particles retained on the sieve of the strongly coking coal of Australian origin. It is also clear from the present example that one half of the entire charging coal is allowed to be substituted with low grade coal when the total moisture content of briquettes is adjusted or the caking substance is added into the briquettes.

TABLE 18

| Run No. | Blended coal (%) Total moisture | Blending ratio: Particles of strongly coking coal of Australian origin retained on the sieve | Particles of strongly coking coal of Australian origin passed through the sieve, semi strongly coking coal and weakly coking coal | Low grade coal, H | Briquettes (%) Total moisture | Blending ratio: Particles of strongly coking coal of Australian origin retained on the sieve | Particles of strongly coal of Australian origin passed through the sieve, semi strongly coking coal and weakly coking coal | Low grade coal, H | Caking substance | Binder (additional) | Total low grade coal content (%) | Coke strength $DI_{15}^{30}$ (%) |
|---|---|---|---|---|---|---|---|---|---|---|---|---|
| 72 | 0 | 0 | 65 | 35 | 8 | 15.2 | 39.8 | 45 | 0 | Road tar 7 | 39 | 92.1 |
| 73 | 0 | 0 | 65 | 35 | 8 | 13.7 | 25.8 | 55 | 5.5 | Coal tar 7 | 43 | 92.2 |
| 74 | 0 | 0 | 65 | 35 | 2 | 14.2 | 30.8 | 55 | 0 | Coal tar 7 | 43 | 92.1 |
| 75 | 0 | 0 | 65 | 35 | 2 | 12.2 | 12.3 | 70 | 5.5 | Coal tar 7 | 49 | 92.1 |
| 76 | 0 | 0 | 65 | 35 | 2 | 12.2 | 12.3 | 70 | 5.5 | Road tar 7 | 49 | 92.2 |

We claim:

1. A method of preparing an effective blast furnace coke which contains substantial amounts of low grade coal, said method comprising the steps of (a) mixing together an amount of coking coal and an amount of low grade coal to form a first blended coal mixture; said amount of coking coal comprising not less than 80% by weight of the weight of the first blended coal mixture and said amount of low grade coal comprising not more than 20% by weight of the weight of the first blended coal mixture, (b) adjusting the moisture content of the first blended coal mixture obtained in step (a) to 4% or less, (c) mixing together an amount of coking coal, an amount of low grade coal and an amount of an additive material selected from the group consisting of binding substances and caking substances to form a second blended coal mixture; said amount of coking coal comprising not less than 10% by weight of the weight of the second blended coal mixture and said amount of low grade coal comprising not more than 90% by weight of the weight of the second blended coal mixture, (d) forming uniformly shaped briquettes from the second blended coal mixture obtained in step (c), (e) mixing an amount of the briquettes formed in step (d) with an amount of the moisture content-adjusted first blended coal mixture formed in step (b) to form a third blended coal mixture; said amount of briquettes comprising not more than 40% by weight of the weight of the third blended coal mixture and said amount of moisture content-adjusted first blended coal mixture comprising not less than 60% by weight of the weight of the third blended coal mixture, and (f) carbonizing the third blended coal mixture to form the blast furnace coke.

2. The method as set forth in claim 1 wherein prior to use in step (e) the briquettes formed in step (d) are adjusted in moisture content to 4% or less.

3. The method as set forth in claim 1 wherein the initial moisture contents of the coking coal and the low grade coal which are mixed together in step (c) to form the second blended coal mixture are adjusted prior to being mixed together such that the briquettes formed from the second blended coal mixture in step (d) have a moisture content of 4% or less.

4. A method of preparing an effective blast furnace coke which contains substantial amounts of low grade coal, said method comprising the steps of (a) pulverizing a coking coal whose coking properties are segregated according to its grain size distribution, (b) depositing the pulverized coking coal of step (a) on a screen and recovering the fine particles of pulverized coking coal which pass through the screen, (c) mixing the recovered fine particles of pulverized coking coal obtained in step (b) with another coking coal to form a coking coal mixture, (d) mixing together an amount of the coking coal mixture obtained in step (c) with an amount of low grade coal to form a first blended coal mixture, said amount of coking coal mixture comprising not less than 65% by weight of the weight of the first blended coal mixture and said amount of low grade coal comprising not more than 35% by weight of the weight of the first blended coal mixture, (e) adjusting the moisture content of the first blended coal mixture obtained in step (d) to 4% or less, (f) mixing together an amount of coking coal, an amount of low grade coal and an amount of an additive material selected from the group consisting of binding substances and caking substances to form a second blended coal mixture; said amount of coking coal comprising not less than 10% by weight of the weight of the second blended coal mixture and said amount of low grade coal comprising not more than 90% by weight of the weight of the second blended coal mixture, (g) forming uniformly shaped briquettes from the second blended coal mixture obtained in step (f), (h) mixing an amount of the briquettes formed in step (g) with an amount of the moisture content-adjusted first blended coal mixture obtained in step (e) to form a third blended coal mixture; said amount of briquettes comprising not more than 40% by weight of the weight of the third blended coal mixture and said amount of moisture content-adjusted first blended coal mixture comprising not less than 60% by weight of the weight of the third blended coal mixture, and (i) carbonizing the third blended coal mixture to form the blast furnace coke.

5. The method as set forth in claim 4 wherein prior to use in step (h) the briquettes formed in step (g) are adjusted in moisture content to 4% or less.

6. The method as set forth in claim 4 wherein the initial contents of the coking coal and the low grade coal which are mixed together in step (f) to form the second blended coal mixture are adjusted prior to being mixed together such that the briquettes formed from the second coal mixture in step (g) have a moisture content of 4% or less.

7. The method as set forth in claim 4 wherein said another coking coal in step (c) comprises the particles of pulverized coking coal retained by the screen in step (b) which have been further pulverized.

8. The method as set forth in claim 4 wherein the coking coal used in step (f) comprises the particles of pulverized coking coal retained by the screen in step (b) which have been further pulverized.

* * * * *